US007074482B1

(12) United States Patent
Nishimura et al.

(10) Patent No.: US 7,074,482 B1
(45) Date of Patent: Jul. 11, 2006

(54) ANTIBACTERIAL POLYAMIDE FIBER AND METHOD FOR PRODUCING THE SAME

(75) Inventors: Masaki Nishimura, Kyoto (JP); Takeshi Nishiyama, Kyoto (JP); Mitsuo Omori, Kyoto (JP); Eiji Tsukamoto, Kyoto (JP); Seiji Abe, Kyoto (JP); Masahiro Hosoda, Kyoto (JP); Hideharu Yamamoto, Kyoto (JP); Minoru Fujii, Osaka (JP); Shuhei Kurata, Kyoto (JP); Kunio Akasaki, Kyoto (JP)

(73) Assignee: Unitika Fibers Ltd., Osaka (JP)

( * ) Notice: Subject to any disclaimer, the term of this patent is extended or adjusted under 35 U.S.C. 154(b) by 527 days.

(21) Appl. No.: 10/204,139

(22) PCT Filed: Oct. 25, 2000

(86) PCT No.: PCT/JP00/07456

§ 371 (c)(1),
(2), (4) Date: Aug. 15, 2002

(87) PCT Pub. No.: WO01/64981

PCT Pub. Date: Sep. 7, 2001

(30) Foreign Application Priority Data

Feb. 28, 2000 (JP) ..... 2000-051416

(51) Int. Cl.
*D01F 6/00* (2006.01)

(52) U.S. Cl. ..... 428/364; 428/372

(58) Field of Classification Search ..... 428/364, 428/395, 373, 372

See application file for complete search history.

(56) References Cited

U.S. PATENT DOCUMENTS

| | | | | |
|---|---|---|---|---|
| 5,180,585 | A * | 1/1993 | Jacobson et al. | 424/405 |
| 5,376,712 | A * | 12/1994 | Nakajima | 524/492 |
| 5,654,096 | A * | 8/1997 | Yamada et al. | 428/373 |
| 5,750,609 | A * | 5/1998 | Nosu et al. | 524/413 |
| 6,121,388 | A * | 9/2000 | Umetsu et al. | 525/425 |
| 6,815,379 | B1 * | 11/2004 | Nomura | 442/123 |
| 6,838,171 | B1 * | 1/2005 | Nomura | 428/364 |

FOREIGN PATENT DOCUMENTS

JP 11-293521 10/1999

OTHER PUBLICATIONS

Database CA 'Online! Chemical Abstracts Service, Columbus, Ohio, US; May 6, 1997, Shimizu, Yoshiko et al: "Polyamide fabrics containing zinc oxide and chitosan for skin-comfortable wearing apparel" XP002329267.
Database WPI Week 199329 Derwent Publications Ltd., London, GB; AN 1993-232846 XP002329283.

(Continued)

*Primary Examiner*—N. Edwards
(74) *Attorney, Agent, or Firm*—Fildes & Outland, P.C.

(57) ABSTRACT

An antibacterial polyamide filament which comprises a polyamide resin containing 0.1 to 5.0 mass % of fine zinc oxide particles and exhibits a color difference caused by the treatment with an alkaline solution of 2.5 or less; and a method for producing the antibacterial polyamide filament which comprises adjusting the moisture content of a polyamide resin chip to 0.05 to 2.0 mass %, followed by melt spinning. Preferably, the antibacterial polyamide filament has a bacteriostatic activity after 50 washings of 2.2 or more, which filament can be produced by melt-spinning the polyamide resin to melt spinning and solidifying the resin at a position 400 mm or less from the face of a spinning nozzle.

6 Claims, 3 Drawing Sheets

OTHER PUBLICATIONS

Patent Abstracts of Japan vol. 1996, No. 02, Feb. 29, 1996 & JP 07 252720 A (Ishizuka Glass Co Ltd) Oct. 3, 1995.

Patent Abstracts of Japan vol. 2000, No. 19, Jun. 5, 2001 055631 A (Unitika Ltd), Feb. 27, 2001.

* cited by examiner

ANTIBACTERIAL POLYAMIDE FIBER AND METHOD FOR PRODUCING THE SAME

TECHNICAL FIELD

This invention relates to an antibacterial polyamide filament, in particular, to an antibacterial polyamide filament which comprises polyamide resin containing an antibacterial agent, is less susceptible to color change (color develop) after being subjected to treatment with an alkaline solution and is excellent in washing resistance; and a method for producing the same.

BACKGROUND ART

There have been proposed a number of antibacterial filaments comprising synthetic filaments, such as polyamide filaments including nylon 6, which contain powder materials having antibacterial properties.

Of the powder materials having antibacterial properties, silver-based inorganic antibacterial agents, in particular, phosphate antibacterial agents carrying silver ions, zeolite antibacterial agents carrying silver ions and calcined hydroxyapatite antibacterial agents carrying silver ions have been widely in use.

The filaments containing such silver-based inorganic antibacterial agents have good antibacterial properties and excellent durability. They, however, undergo color changes (color development) when subjected to treatment with an alkaline solution so as to scour sizing agents, which has been provided to improve weaving properties, away in the step prior to dyeing operation because the silver as an antibacterial component is oxidized by the treatment, what is worse, their antibacterial properties deteriorate. Thus silver inorganic antibacterial agents have disadvantages in that they are not suitably used in applications where treatment with an alkaline solution is carried out.

In order to prevent color change in filaments and to improve the whiteness of the same, there have been proposed antibacterial filaments having been treated with color-change preventing agents, such as sodium percarbonate, sodium hypochlorite or azole compounds having no mercapt group, in JP-A-4-50376, JP-A-6-264360 and JP-A-6-272173. These filaments, though they have been treated with color-change preventing agents, still have the problems in that they are unable to satisfactorily avoid color change (color development) caused by treatment with an alkaline solution, the treatment is complicated, and that they are hard to use in applications, such as clothing applications, where whiteness is required.

SUMMARY OF INVENTION

Accordingly, the technical problem which confronts the inventors is how to provide an antibacterial polyamide filament which develops good antibacterial properties, is less susceptible to color changes (color development) and deterioration of antibacterial properties even after subjected to treatment with an alkaline solution and is excellent in washing resistance; and how to provide a method for producing the same.

In order to solve the above problem, the antibacterial polyamide filament of the invention comprises polyamide resin containing 0.1 to 5.0 mass % of fine zinc oxide particles and exhibits a color difference caused by treatment of an alkaline solution of 2.5 or less.

For the fine zinc oxide particles contained in the polyamide resin, preferably its surface is coated with a coupling agent.

According to the invention, preferably the filament has a modified cross-section with modification degree of 20 to 60%.

The antibacterial polyamide crimped yarn of the invention is produced by providing the above antibacterial polyamide filament with crimp.

An antibacterial polyamide woven and knitted fabric of the invention is knitted and woven using, at least in parts, the above antibacterial polyamide filament or the above antibacterial polyamide crimped yarn.

The method for producing the antibacterial polyamide filament of the invention includes the steps of adjusting polyamide resin chips containing 0.1 to 5.0 mass % of fine zinc oxide particles to have a moisture content of 0.05 to 2.0 mass %, and then melt-spinning the adjusted chips.

In this production method, preferably surfaces of fine zinc oxide particles are coated with a coupling agent.

The antibacterial polyamide filament of the invention comprises polyamide resin containing 0.1 to 5.0 mass % of fine zinc oxide and exhibits a color difference of the filament caused by treatment with an alkaline solution of 2.5 or less, and the bacteriostatic activity of the same after 50-time washing is 2.2 or more.

In this antibacterial polyamide filament, preferably the surfaces of the fine zinc oxide particles are coated with a coupling agent.

Preferably, this antibacterial polyamide filament has a modified cross-section with a modification degree of 20 to 60%.

The antibacterial polyamide crimped yarn of the invention using this antibacterial polyamide filament produced by providing the above antibacterial polyamide filament with crimp.

The antibacterial polyamide woven and knitted fabric of the invention using this antibacterial polyamide filament is produced by knitting and weaving, at least in parts, the above antibacterial polyamide filament or the above antibacterial polyamide crimped yarn.

The method for producing this antibacterial polyamide filament includes the steps of: adjusting a moisture content of polyamide resin chips containing 0.1 to 5.0 mass % of fine zinc oxide particles to 0.05 to 2.0 mass %; melt-spinning the adjusted polyamide resin chips and discharging the undrawn filament through a spinning nozzle; and solidifying the spun filament at the position within 400 mm away from the nozzle face.

In this production method, preferably the surfaces of the fine zinc oxide particles are coated with a coupling agent.

DISCLOSURE OF INVENTION

Figure 1:
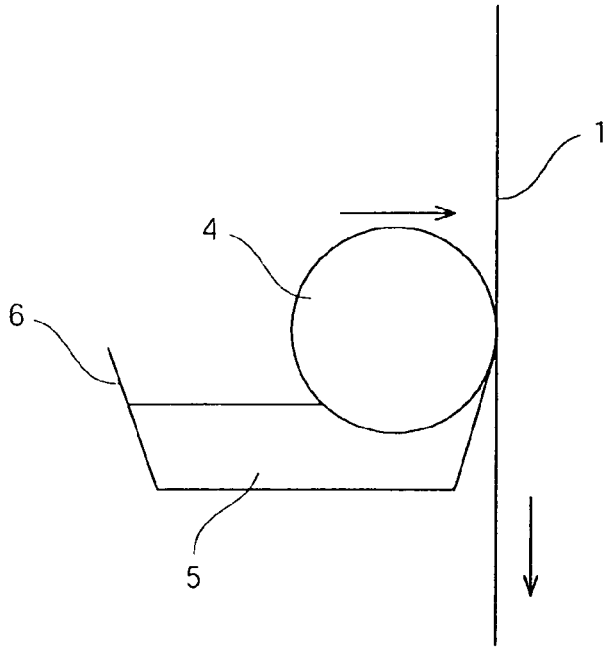
FIG. 1 is a view showing roller-type liquid medium supplying means in accordance with this invention.

The polyamides constituting the antibacterial polyamide filament and antibacterial polyamide crimped yarn of the invention include: for example, nylon 6, nylon 66, nylon 69 and nylon 46, as a sole polyamide; the copolymers thereof; and the blends thereof. The polyamides may contain, for example, a delustering agent, a modifier, an antistatic agent and a pigment as long as an effect of the invention is not impaired.

The antibacterial agent contained in the filament is fine zinc oxide particles. Fine zinc oxide particles have not only ultraviolet absorbing and deodorizing actions, but also bactericidal and antibacterial actions. The bactericidal and antibacterial performances of fine zinc oxide particles are considered to develop due to one of the chemical characteristics of zinc oxide, that is, high affinity for sulfur. In particular, it is presumed that fine zinc oxide particles act on the thiol groups of enzymes existing in the cell membrane of bacteria in some way and thereby lowers the activity of bacteria.

In order to prevent the problem of, for example, guide wear from occurring during the steps of spinning to taking up in the production process of the filament and thereby improve the step passing performance and in order to prevent the buildup of nozzle pack pressure, preferably the fine zinc oxide particles contained in the filament are 0.01 to 5.0 μm in mean particle diameter.

Preferably the surfaces of the fine zinc oxide particles are coated with a coupling agent. The reason is that, fine zinc oxide has photocatalytic activity, photo-deterioration may occur in resins containing zinc oxide.

The reaction induced by the photocatalytic activity of fine zinc oxide particles is occurred on the particle surface. Thus, there have been made attempts to suppress the photocatalytic activity by subjecting the particle surface to some treatment. For example, microencapsulization surface treatment has been done to avoid contact with oxygen and water. The fine zinc oxide particles having been subjected to this treatment, however, have the problem of losing its chemical characteristics, though it still has optical characteristics of zinc oxide.

Thus, in this invention, in order to suppress the photocatalytic activity of fine zinc oxide particles while allowing the optical and chemical characteristics to remain, preferably used are fine zinc oxide particles of which particle surfaces are coated with a coupling agent.

The coupling agents used are not limited to any specific ones, but preferably silane coupling agents, such as "KBM-403" and "KBM-503" manufactured by Shin-Etsu Chemical Co., Ltd., are used.

The coupling agents other than silane coupling agents include, for example, titanium, aluminium, zirconium and zirconium aluminate coupling agents.

The amount of coupling agent used for coating is preferably about 0.1 to 20 mass %, though it depends on the surface area of the fine zinc oxide particles.

The use of a coupling agent for coating the surfaces of fine zinc oxide particles makes it possible to suppress the photocatalytic activity of fine zinc oxide particles satisfactorily using only small amount of agent and without waste of agent. Meanwhile it allows the ultraviolet absorbing action as well as bactericidal and antibacterial actions to remain the same as before. Thus in the filament containing fine zinc oxide particles of which surfaces are coated with such a coupling agent, its color change to be caused by ultraviolet rays can be effectively prevented, and at the same time, its antibacterial and bactericidal effects are achieved.

When treatment with such a coupling agent is not applied, desirably an organic ultraviolet absorbing agent, such as hindered phenol, benzophenone, benzotriazole or cyanoacrylate ultraviolet absorbing agent, and an antioxidant are added to the fabric, because the photocatalytic activity excited by ultraviolet rays is high and thereby deterioration of polymer is likely to be accelerated.

In the filament of this invention, fine zinc oxide particles content of the polyamide resin is 0.1 to 5.0 mass %, and preferably 0.3 to 3.5 mass %. If the content is less than 0.1 mass %, the filament does not show the satisfactory antibacterial performance. If the content is more than 5.0 mass %, operating efficiency is lowered in the production of the filament because of frequent occurrence of end breakage during spinning or drawing or because of frequent occurrence of end breakage or fluff due to the wear of the guide, reed or heddle during weaving, and moreover, not only the antibacterial performance reaches saturation with which production cost rises, but also yarn performance such as strength and elongation deteriorates.

The filament of this invention may be provided with a mite repellent, a deodorizer, etc. by aftertreatment as long as they do not inhibit the development of antibacterial performance, or it may be subjected to water repellent finish, water vapor permeating and waterproof finish, etc.

The filament of this invention has both color change (color development) preventive effect and antibacterial effect since it contains the above described antibacterial agent and exhibits a color difference ΔE in the filament between before and after alkaline treatment of an alkaline solution of 2.5 or less.

In this invention, the color difference before and after treatment with an alkaline solution is obtained by making measurements, with a spectrophotometer (Macbeth, CE-3100), for the tubularly knitted fabric of the filament of the invention before treatment with an alkaline solution and after treatment with an alkaline solution in such a state that eight sheets of each knitted fabric are laid one on top of another.

In particular, when the surfaces of fine zinc oxide particles are not coated with a coupling agent, the color difference ΔE between before and after treatment with an alkaline solution is 2.5 or less, preferably 2.0 or less, and more preferably 1.5 or less. But, on the other hand, when the surfaces of fine zinc oxide particles are coated with a coupling agent, the color difference ΔE between before and after treatment with an alkaline solution is 2.0 or less, preferably 1.5 or less, and more preferably 1.0 or less.

In the filament of which color difference ΔE between before and after treatment with an alkaline solution is more than 2.5, the degree of color development in the filament due to treatment with an alkaline solution, such as scouring treatment, is high. And if the filament contains neither pigment nor colorant, its whiteness degree is lowered. If the filament contains a pigment or a colorant, its clarity deteriorates, and hence its performance deteriorates. Furthermore, its antibacterial properties can sometimes be remarkably lowered by the reaction with an alkali.

The pigments and colorants which can be contained in the filament include: for example, carbon black (channel black is particularly preferable), yellow pigment (e.g. Yellow 10 G, by Bayer), blue pigment (e.g. cyanine blue, by Dainichiseika Colour & Chemicals Mfg. Co., Ltd.), green pigment (e.g. cyanine green, by Dainichiseika Colour & Chemicals Mfg. Co., Ltd.), red pigment (e.g. durene red, by DIC) and purple pigment (e.g. Sandorin violet BL, by SANDOZ).

In the antibacterial polyamide filament of the invention, preferably it has a modified cross-section with modification degree of 20 to 60%. Such modified cross-section increases the surface area of the filament, which allows the filament, or fine zinc oxide particles to produce more antibacterial effect, resulting in improvement of antibacterial properties. Furthermore, such modified cross-section is advantageous in cooling the filament having been discharged from a nozzle face described later and enables its solidifying point to be closer to the nozzle face. This enables the antibacterial filament of the invention, or fine zinc oxide particles to fully produce antibacterial effect, leading to improvement in antibacterial properties and their persistency. This, in turn, reduces the fine zinc oxide particles content needed for achieving the required antibacterial properties, and hence the filament production cost.

The term "modification degree" herein used means the numerical value (%) obtained by multiplying the value, obtained by dividing the diameter of the inscribed circle in the cross-sectional shape of the filament by the diameter of the circumscribed circle, by 100. The modified cross-sections include: for example polygonal cross-sections such as triangle and quadrangle; multifoliate cross-sections with a number of irregularities; and cross-sections in the shapes of Chinese characters, "田" and "井".

The filament of the invention may have a hollow portion, regardless of whether it has a modified cross-section or not. In order to avoid the occurrence of end breakage and fluff during weaving, the filament of the invention may be of core-sheath construction in which the core portion alone contain fine zinc oxide particles. Further, the filament of the invention may be a staple filament or a long filament, and when it is a long filament, it may be a multifilament or a monofilament. Preferably, both short and long filaments have a single yarn fineness of 0.5 to 2300 dtex.

In the filament of the invention, preferably its bacteriostatic activity after 50-time washing is 2.2 or more and/or its bacteriocidal activity after 50-time washing is 0 or more. The term "bacteriostatic activity and bacteriocidal activity after 50-time washing" herein used means the evaluation of antibacterial properties carried out with *Staphylococcus aureau* ATCC 6538P) as a test bacterium by measuring the bacteriostatic activity and bacteriocidal activity after 50-time washing for the antibacterial filament or fabric obtained by tubularly knitting of the crimped yarn thereof in accordance with the manual of quantitatively testing methods for antibacterial of textiles (standardized testing methods) stipulated by Japan Association for Function Evaluation of Textiles (JAFET). In the invention, the bacteriostatic activity was evaluated for each of the untreated sample and the samples subjected to treatment with an alkaline solution, dyeing, 50-time washing and weatherproofing (untreated sample was directly subjected to weather proofing) and the bacteriocidal activity was evaluated for the untreated sample and the sample subjected to 50-time washing (antibacterial evaluation).

Treatment with an alkaline solution was done in such a manner as to boil the knitted fabric in 0.1% aqueous solution of sodium hydroxide for 30 minutes. Fifty-time washing was performed in accordance with JIS L 0217-103 for each of the samples having been subjected to treatment with an alkaline solution and dyeing. Weatherproofing was done with a carbon-arc fadeometer in such a manner as to irradiate (fourth grade irradiation) the filament at 63° C. for 20 hours in accordance with JIS L 0842.

The reasons that the invention adopts the bacteriostatic activity and bacteriocidal activity after 50-time washing as the standard are as follows.

In the filament produced by applying the publicly known method in which the surface of the filament is coated with an antibacterial agent in the postprocessing step, antibacterial properties markedly deteriorate after only several-time washing; therefore, it is difficult to use such filament for clothing in which washing is repeated many times. The 50-time washing adopted in the invention is for the filament having improved in washing resistance compared with the filament produced by applying the publicly known method (in the filament produced by applying the publicly known method, washing resistance deteriorates after several-to 10-time washing, but in the filament of the invention, it does not deteriorate even after 50-time washing), and judging from the number of washings adopted for SEK evaluation by Japan Association for Function Evaluation of Textiles (JAFET) being up to 50 times (in the clothing/bed cloth applications), it can be said that the filament of the invention has satisfactory washing resistance even in the clothing applications.

According to the investigation of antibacterial and deodorizing effects (Report on Evaluation Standard WG by Antibacteria and Deodorization Finish Section of Japan Association for Function Evaluation of Textiles), odor development due to resident bacteria on the skin is suppressed when the bacteriostatic activity of a filament is 2.2 or more. Therefore, in the invention, a bacteriostatic activity of 2.2 or more, an index of development of substantial antibacterial effect when using a filament for clothing, is adopted.

Bacteriocidal activity is a bacteriostatic finish evaluation stipulated by JAFET, and when the activity of a filament is 0 or more, bacterial multiplication on the filament is suppressed. Therefore, it is favorable to use a filament with a bacteriocidal activity of 0 or more in the applications aimed at improvement of living environment (living, life) and care environment (health, medical). Accordingly, in the invention, a bacteriocidal activity of 0 or more is adopted.

It means that a filament of which bacteriostatic activity after 50-time washing is less than 2.2 and/or bacteriocidal activity after 50-time washing is less than 0 is a filament of which antibacterial properties deteriorate after many-time washing and which cannot maintain antibacterial properties. Accordingly, such a filament is hard to use in the clothing applications or medical applications where resistance to washing is required.

Thus, bacteriostatic activity after 50-time washing is more preferably 3.0 or more, and still more preferably 4.0 or more. Likewise, bacteriocidal activity after 50-time washing is more preferably 1.0 or more, and still more preferably 2.0 or more.

In the following, the method for producing an antibacterial filament of the invention will be described.

First polyamide resin chips containing 0.1 to 5.0 mass % of fine zinc oxide particles coated or uncoated with a coupling agent are produced, then the moisture content of the chips is adjusted to 0.05 to 2.0 mass % and the adjusted chips are subjected to melt spinning.

When producing the polyamide resin chips containing 0.1 to 5.0 mass % of fine zinc oxide particles, a method that can be adopted is not only the method in which chips containing such an amount of fine zinc oxide particles from the outset are produced, but also the method in which fine zinc oxide particles are blended with polyamide resin chips and in which polyamide resin chips containing fine zinc oxide particles at a high concentration from the outset are produced and then these chips are blended with ordinary polyamide. In either case, however, the moisture content of the resin chips used is adjusted to be in the above range.

To allow the moisture content of the resin chips to be in the above range, the chips should be dried at about 90 to 160° C.

The color development or color change in the polyamide filament obtained has to do with the moisture content of the resin chips. This is because a polyamide filament is susceptible to deterioration, such as hydrolysis, when it is in the melted state, and the more the moisture content increases, the larger the color development or color change becomes. Therefore, if the resin chips are subjected to melt spinning after their moisture content is adjusted to be in the above range, a filament can be obtained in which color development after treatment with an alkaline solution is smaller. In other words, even if there is no difference in color development or color change among filaments before treatment with an alkaline solution, the filament produced from the chips having a larger moisture content is subjected to larger color development or color change after treatment with an alkaline solution.

If the moisture content of the chips is more than 2.0 mass %, color development or color change in the filament obtained becomes larger, and it becomes difficult to suppress the color-difference ΔE before and after treatment with an alkaline solution to 2.5 or less. On the contrary, if the moisture content of the chips is less than 0.05 mass %, the process of drying the chips to this level takes more time, the production cost rises, and the physical properties, such as strength and elongation, of the filament obtained are likely to deteriorate.

When producing a long filament (multifilament) as a polyamide filament of the invention, either the two-step method, in which an undrawn filament is taken up first and then the filament is drawn, or the directly spinning and drawing method, in which an undrawn filament is cooled first and then taken up at a take-up rate of 100 m/min or faster, may be adopted. The details will be described below.

When producing a filament of the invention by the two-step method in which an undrawn filament is taken up first and then drawn, preferably the take-up rate is about 25 to 1500 m/min and the draw rate is about 1.5 to 6.0. Either of hot drawing and cold drawing at room temperature may be adopted depending on the type of filament, and if hot drawing is adopted, preferably it is carried out at about 50 to 170° C.

When producing a filament of the invention by the directly spinning and drawing method, the spun filament is not taken up before drawing, but is taken up at a take-up rate of 100 m/min or faster, as described above. And drawing may be carried out during the take-up operation, and in that case, preferably the filament is drawn at a draw rate of about 1.1 to 3.0 while being heated at about 50 to 150° C.

Generally, when adopting the directly spinning and drawing method to produce a filament from polymer containing fine particles, guide wear is likely to occur, compared with when adopting the two-step method, which in turn causes end breakage etc., and consequently, operating efficiency is likely to decrease. However, in the case of this invention, in which fine zinc oxide particles of which surfaces are coated with a coupling agent are used, since only a suitable amount of fine zinc oxide particles is contained in the polyamide resin chips, guide wear will not occur, and a filament can be produced at high operating efficiency even in adopting the directly spinning and drawing method.

In the following, a method for producing the filament according to this invention of which bacteriostatic activity after 50-time washing is 2.2 or more and/or bacteriocidal activity after 50-time washing is 0 or more will be described in detail.

In this case, first polyamide resin chips containing 0.1 to 5.0 mass % of fine zinc oxide particles coated or uncoated with a coupling agent are produced, the moisture content of the chips is adjusted to 0.05 to 2.0 mass %, the chips are subjected to melt spinning, and the spun filament in the melted state should be cooled and solidified at the position within 400 mm away from the spinning nozzle face.

The distance from the nozzle face to the solidifying point largely affects the durability of antibacterial performance of the filament obtained. The term "solidifying point" herein used means the point at which the diameter of the filament discharged through the nozzle becomes substantially constant for the first time, in other words, the point at which the filament is solidified. When calculating the distance from the nozzle face to the solidifying point, for a monofilament, the filament diameter of the single filament is used, and for a multifilament, the average filament diameter of the respective single filaments is used.

The solidifying point under normal spinning conditions is in the range of 600 to 2000 mm, though it depends on single yarn fineness. In this invention, the undrawn filament must be solidified by adopting the method described later so as to position the solidifying point to be within 400 mm away from the nozzle face.

Positioning the solidifying point to be within 400 mm away from the nozzle face results in cooling and solidifying the polyamide discharged through the nozzle orifices in the melted state in a shorter period of time and prevent the antibacterial agent from bleeding out on the filament surface, whereby the state can be accomplished in which the antibacterial agent is not localized on the filament surface, but contained in the filament uniformly.

Once bleeding out on the filament surface, the antibacterial agent is likely to fall away from the filament surface, which shortens the duration of the antibacterial performance and makes the filament less washing resistant. The closer to the nozzle face the solidifying point becomes, the more the bleedout of the antibacterial agent on the filament surface can be prevented and the more the durability of the antibacterial performance is improved. Accordingly, preferably the solidifying point is positioned within 350 mm away from the nozzle face.

The methods for positioning the solidifying point within 400 mm away from the nozzle face may include, for example, holding the temperature of the melting polymer lower when it is discharged through the nozzle orifices, lowering the temperature of the cooling air flowed onto the spun filament in the melted state discharged through the nozzle orifices and increasing the amount of the cooling air flowed, cooling the filament with a liquid medium such as water and so on.

When adopting the method in which the temperature of the polymer is held low at the time of being discharged through the nozzle orifices, preferably the temperature range of the polymer at the time of being discharged is from 235° C. to 255° C., more preferably 250° C. or lower, still more preferably 245° C. or lower. Under normal spinning conditions for polyamide resin, the polymer temperature is often higher than 255° C. If the polymer temperature is 258° C., for example, it is difficult to position the solidifying point within 400 mm away from the nozzle face under normal cooling conditions, the antibacterial agent bleeds out on the filament surface, and thereby the antibacterial filament obtained becomes less washing resistant.

If the polymer temperature at the time of being discharged is 235° C. or lower, end breakage is likely to occur during spinning because of the occurrence of undissolved matter.

When adopting the method in which the spun filament in the melted state is solidified with cooling air, preferably the temperature of the cooling air is 10° C. or lower. If the temperature of the cooling air is higher than 10° C., it is difficult to position the solidifying point within 400 mm away from the nozzle face.

Flowing a larger amount of cooling air is more advantageous to solidify the spun filament in the melted state, and hence preferable. The speed of the cooling air sprayed is preferably 1.5 to 2.5 m/min, and more preferably 1.7 to 2.3 m/min. The speed of the cooling air flowed higher than 2.5 m/min is likely to cause end breakage during spinning, and hence not preferable. In general methods for spinning polyamide filament, which is out of the scope of this invention, the speed of the cooling air flowed is lower than 1.5 m/min; however, in this invention, the speed lower than 1.5 m/min is not sufficient for cooling and sometimes makes it difficult to position the solidifying point within 400 mm away from the nozzle face.

Cooling and solidifying a filament are affected by the fineness of its single filament, and a filament with smaller single filament fineness is advantageous to cooling because it can have a larger surface area. Therefore, in the filament with a single filament fineness less than 3.3 dtex, preferably solidifying with cooling air is adopted, and in the filament with a single filament fineness of 3.3 to 100 dtex, preferably roller-type or slit nozzle-type solidifying with a liquid medium described later, which is a more efficient method, is adopted. In the filament with a single filament fineness more than 100 dtex, preferably a still more efficient method, in which the filament is quenched in a liquid bath or in which the filament is sprayed with a liquid coolant using a spraying apparatus, is adopted.

In the following solidifying with a liquid medium will be described. In this case, liquid media, such as water and lubricant, are used as a cooling medium, and the use of a liquid medium is more efficient than the use of cooling air because of its larger specific heat. Accordingly, even in the filament with a single filament fineness of 3.3 dtex or more, it is easy to position the solidifying point within 400 mm away from the nozzle face.

Figure 2:
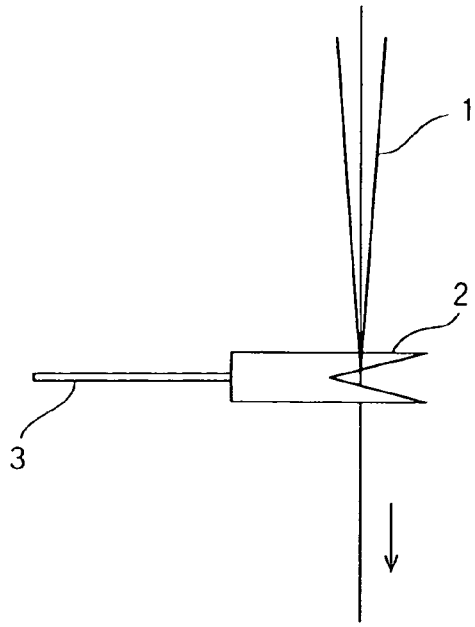
FIG. 2 is a view showing slit-nozzle-type liquid medium supplying means in accordance with this invention.

Specifically, a spun filament can be cooled and solidified in such a manner as to provide roller-type liquid medium supplying means, as shown in FIG. 1, or slit nozzle-type liquid medium supplying means, as shown in FIG. 2, within 400 mm away from the nozzle face, preferably within 350 mm away from the nozzle face. The use of the roller-type or slit nozzle-type liquid medium supplying means enables the spinning speed to be 1000 m/min or higher; therefore, it is preferable from the viewpoint of productivity, compared with the methods described later in which a spun filament is quenched in a liquid bath and in which a filament is sprayed with a liquid coolant using a spraying apparatus.

In particular, in the roller-type liquid medium supplying means shown in FIG. 1, a liquid 5 in a liquid bath 6 is supplied first to a roller 4, then provided for a spun filament 1 in the melted state from the roller 4. In the slit nozzle-type liquid medium supplying means shown in FIG. 2, a liquid medium such as lubricant is supplied first to a slit nozzle 2 through a liquid supplying pipe 3, then provided for a spun filament 1 in the melted state from the slit nozzle 2.

The above described means, in which a filament is quenched in a liquid bath and in which a liquid medium is provided for a filament with a spraying apparatus, may also be used.

These cooling and solidifying means may be used separately, or two or more may be used in combination. Further, these cooling means may be used for cooling together with a cooling-air spraying apparatus.

As a "liquid medium" herein used, in particular, water, polyalkyl glycol, or spinning lubricants containing mineral oil, organic acid, ethers, etc. are preferable. These liquid media may be used separately or two or more may be used together as a mixture. The liquid media may contain various additives such as finishing agent.

The lower the temperature of the liquid media is, the higher the cooling effect on a filament becomes. However, from the economic viewpoint, the temperature is preferably −20 to 50° C., more preferably −10 to 30° C., still more preferably 0 to 10° C.

When producing an antibacterial filament of the invention in such a manner as to position the solidifying point within 400 mm away from the nozzle face by the above methods, the antibacterial agent does not bleed out on the filament surface during spinning, whereby an filament with an antibacterial agent contained in its inside in a uniformly dispersed state is obtained. Therefore, even after many-time washing, the antibacterial agent does not fall away from the filament and thereby the antibacterial properties are maintained, which enables the use of the filament in clothing applications where washing resistance is required.

The filament of the invention also has a highly antibacterial performance even after weatherproofing, and its bacteriostatic activity after weatherproofing can be 2.2 or more. The reasons for this are not clear yet; however, it is presumed that the deterioration of an antibacterial agent due to weatherproofing is suppressed because the antibacterial agent is not localized on the filament surface, but dispersed uniformly over the cross-section of the filament.

When producing a filament according to the invention, of which bactriostatic activity after 50-time washing is 2.2 or more and/or bacteriocidal activity after 50-time washing is 0 or more, either one of the following methods may be adopted: the two-step method in which an undrawn filament is taken up first and then the filament is drawn; and the directly spinning and drawing method in which an undrawn filament is cooled first and then taken up at a take-up rate of 100 m/min or faster. The details will be described below.

When producing a filament of the invention by the two-step method in which an undrawn filament is taken up first and then drawn, preferably the take-up rate is about 25 to 1500 m/min and the draw rate is about 1.5 to 6.0. Either of hot drawing and cold drawing at room temperature may be adopted depending on the type of the filament, and if hot drawing is adopted, preferably it is carried out at about 50 to 170° C.

When producing a filament of the invention by the directly spinning and drawing method, the undrawn filament is not taken up before drawing, but is taken up at a take-up rate of 100 m/min or faster. In this case, preferably the larger the single yarn fineness of the filament to be obtained is, the lower the needed spinning speed becomes. For example, when the single yarn fineness is 0.6 to 3.3 dtex, preferably the spinning speed is 500 to 5000 m/min; when the single yarn fineness is 3.3 to 100 dtex, preferably the spinning speed is 500 to 3000 m/min; and when the single yarn fineness is more than 100 dtex, preferably the spinning speed is 100 to 1500 m/min.

Drawing may be carried out during the take-up operation, and in that case, preferably the filament is drawn at a draw rate of about 1.1 to 3.0 while being heated at about 50 to 150° C.

Figure 3:
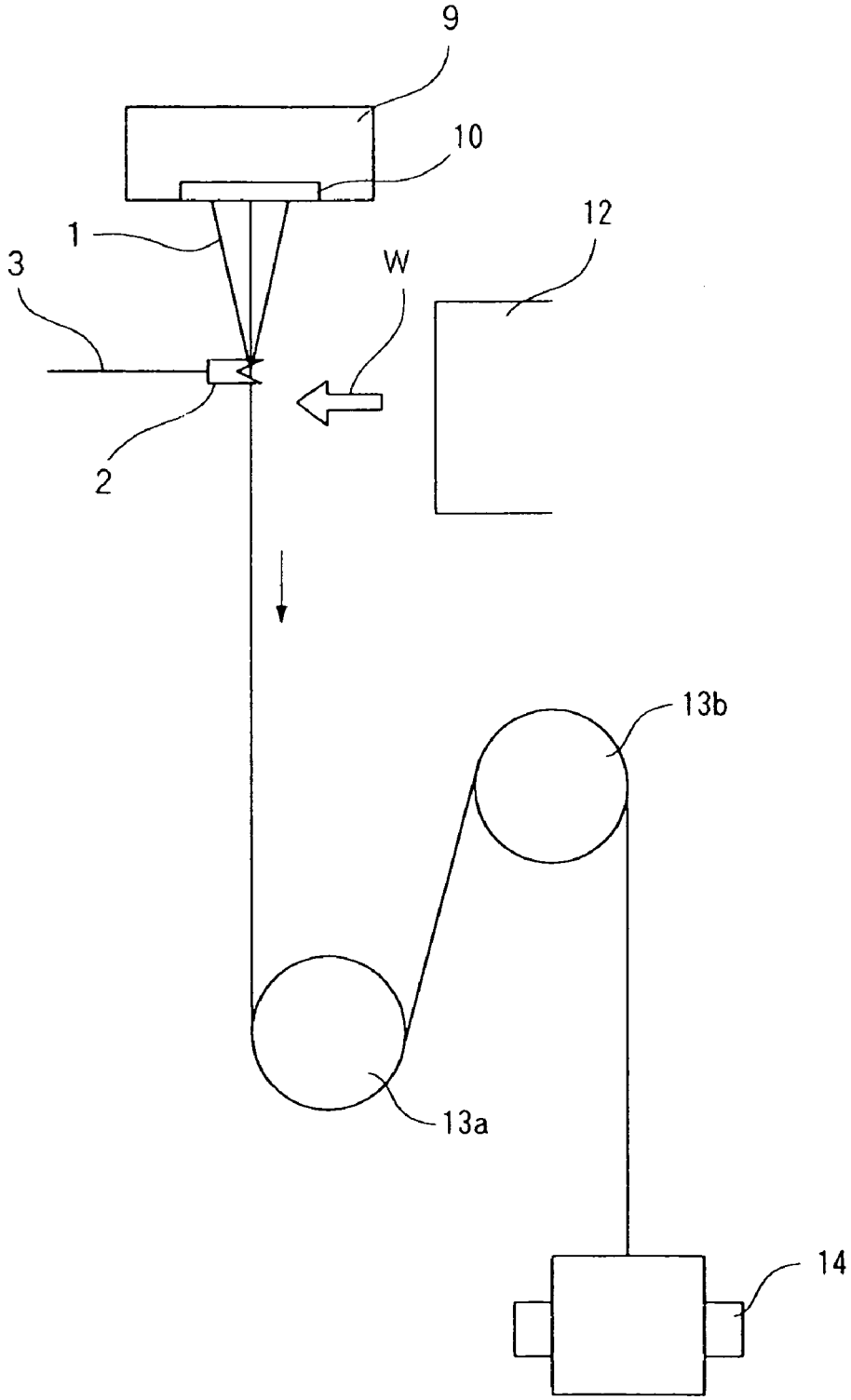
FIG. 3 is a diagrammatic view showing a production process in accordance with this invention which adopts a directly spinning and drawing method.

Described below with reference to FIG. 3 is the production process for an antibacterial polyamide filament of which bacteriostatic activity after 50-time washing is 2.2 or more and/or bacteriocidal activity after 50-time washing is 0 or more, where the directly spinning and drawing method is adopted as an example of the production methods of the invention.

Filaments 1 spun from a spinning nozzle 10 placed in a spin head 9 are provided with a cooling liquid medium from a supplying pipe 3 through a slit nozzle 2, so as to be cooled and solidified. Here cooling is carried out using a cooling apparatus 12, for spraying cooling air W on the filament, together. Then the filament is passed through haul-off rollers 13*a*, 13*b* and taken up with a take-up apparatus 14.

Figure 4:
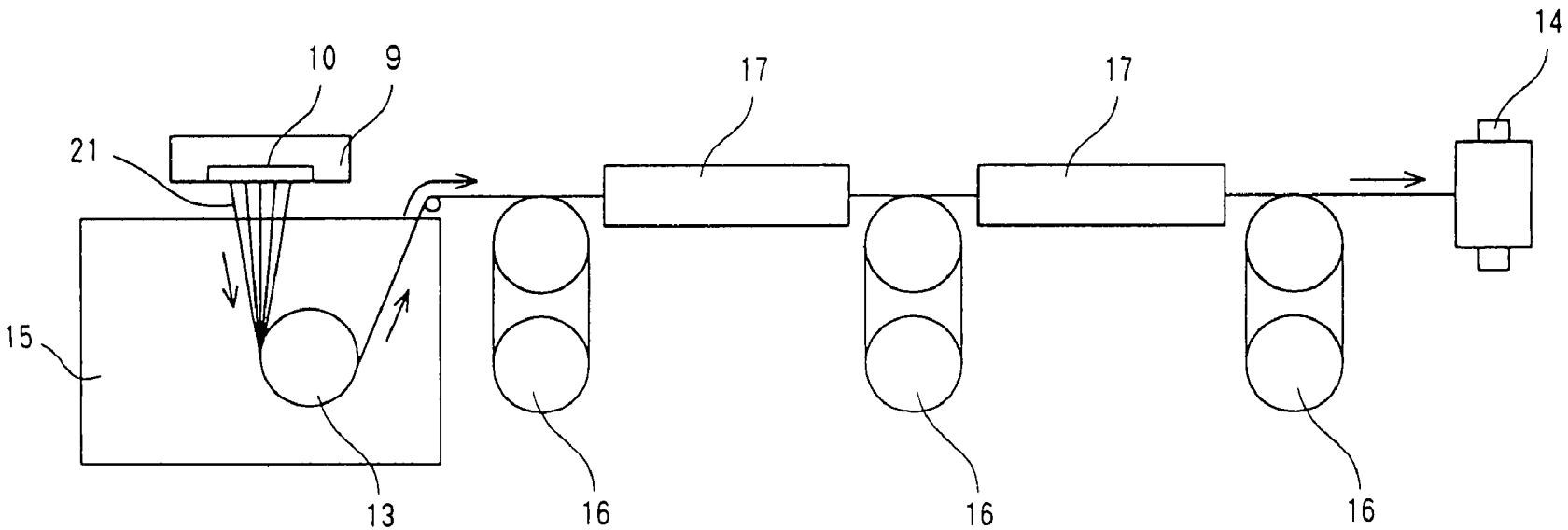
FIG. 4 is a diagrammatic view showing a production process in accordance with this invention where the undrawn filament is a monofilament.

Then, one example of the production processes of an antibacterial polyamide filament, which has a bacteriostatic activity of 2.2 or more and/or a bacteriocidal activity of 0 or more after 50-time washing, where undrawn filaments are monofilaments will be described with reference to FIG. 4. In this process, monofilaments 21 spun through a spinning nozzle 10 placed in a spin head 9 are hauled off with a haul-off roller 13 while being quenched in a liquid bath 15, then subjected to hot drawing and thermosolidification with hot air heaters 17 provided between multiple drawing rollers 16, and taken up with a take-up apparatus 14.

In the following the crimped yarn according to the invention will be described. When producing such a crimped yarn, the filament obtained as described above is subjected to crimping. The methods for providing the filament with crimp include, for example, the false twisting method, the force crimping method and the fluid force crimping method using a heated fluid. Among all these methods, the false twisting method is preferable from the viewpoint of quality stability and cost.

As a false twisting machine, ordinary false twisting machines provided with a pin-type or a disc-type twister can be used. False twisting conditions can be appropriately selected within the range of ordinary conditions, and generally the conditions are preferably selected in such a manner that the false twist multiplier expressed by the product of the number of false twist (T/M) and the square root of filament fineness (d) is in the range of 15000 to 33000. However, the conditions are not limited to the above ones, as long as crimp is obtained, and double-heater false twisting may also be performed in which heat treatment is carried out successively after false twisting to control torque.

In the following the woven and knitted fabric according to the invention will be described. The antibacterial polyamide woven and knitted fabric of the invention is knitted and woven using, at least in parts, the antibacterial polyamide filament or the antibacterial polyamide crimped yarn of the invention. In particular, the antibacterial polyamide woven and knitted fabric of the invention is preferably produced using the antibacterial polyamide filament or the antibacterial polyamide crimped yarn of the invention throughout the fabric; however, it may also be produced using a confounded mixed filament yarn or plied yarn, which has been produced in advance using the antibacterial polyamide filament or crimped yarn of the invention together with other filaments, as long as they have sufficient antibacterial properties. Or the antibacterial polyamide woven and knitted fabric of the invention may be uniformly woven and knitted fabric produced using the antibacterial polyamide filament or crimped yarn of the invention together with other filaments.

The ratio of the antibacterial filament or the antibacterial crimped yarn to the woven or knitted fabric can be appropriately selected according to applications taking into account their requirements such as antibacterial performance and feeling.

Conditions under which the woven and knitted fabric is produced are not particularly restricted, but weaving and knitting can be performed by a conventional procedure.

As described so far, in the antibacterial polyamide filament and the antibacterial crimped yarn of the invention, their color difference before and after treatment with an alkaline solution is 2.5 or less, their whiteness is excellent when they contain neither pigment nor dye, their clarity is excellent when they contain pigment or dye, and moreover, the antibacterial properties last long. Accordingly, the woven and knitted fabric of the invention produced using the filament or the crimped yarn in parts or throughout the fabric can be pigmented to desired colors.

Of the antibacterial polyamide filaments of the invention, the filament of which bacteriostatic activity after 50-time washing is 2.2 or more and/or bacteriocidal activity after 50-time washing is 0 or more can be suitably used particularly in, for example, clothing applications where washing resistance is required. Of the antibacterial polyamide filaments of the invention, those containing fine zinc oxide particles of which surfaces are not coated with a coupling agent can be suitably used in applications such as component yarn for bed mattresses and lining material for bags, which are scarcely exposed to ultraviolet rays.

According to the method for producing an antibacterial polyamide filament of the invention, the filament and the crimped yarn as described above can be produced at high operating efficiency.

In the antibacterial polyamide woven and knitted fabric of the invention, color change (color development) and deterioration of antibacterial properties hardly occur even after treatment with an alkaline solution, since they are produced using, at least in parts, the antibacterial polyamide filament or the antibacterial polyamide crimped yarn of the invention; accordingly, they can be suitably used in applications where whiteness and clarity are required.

EXAMPLES

In the following the invention will be described in detail taking some examples.

The characteristic values in the examples were determined as follows.

(a) Strength and Elongation

The determination was made in accordance with JIS L 1090.

(b) Antibacterial Properties

As described above, the bacteriostatic activity and bacteriocidal activity were determined for the knitted fabric produced by tubular knitting a filament, the object to be measured, and the crimped yarn thereof using *Staphylococcus aurenus* ATCC 6538P as a test bacterium in accordance with the manual of quantitatively testing methods for antibacterial of textiles (standardized testing methods) stipulated by Japan Association for Function Evaluation of Textiles (JAFET). The bacteriostatic activity was evaluated for each of the untreated sample and the samples having been subjected to treatment with an alkaline solution, dyeing, 50-time washing and weatherproofing (untreated sample was directly subjected to weatherproofing) and the bacteriocidal activity was evaluated for the untreated sample and the sample having been subjected to 50-time washing. Treatment with an alkaline solution was done in such a manner as to boil the knitted fabric in 0.1% aqueous solution of sodium hydroxide for 30 minutes. Fifty-time washing was performed in accordance with JIS L 0217-103 for each of the samples having been subjected to treatment with an alkaline solution and dyeing. Weatherproofing test was done in accordance with JIS L 1013.

(c) Color Difference ΔE Before and After Treatment with an Alkaline Solution

As described above, the color difference in the fabric before and after treatment with an alkaline solution is obtained by making measurements, with a spectrophotometer (Macbeth, CE-3100), for the tubularly knitted fabric of the filament of the invention before treatment with an alkaline solution and after treatment with an alkaline solution in such a state that 8 sheets of each knitted fabric are laid one on top of another.

Example 1

Chips of nylon 6 with a relative viscosity of 2.53 (measured using 96% sulfuric acid as a solvent, at a concentration of 1 g/deciliter, at 25° C.) which contain 1.0 mass % of fine zinc oxide particles (average particle diameter 0.2 μm) as an antibacterial agent and 0.5 mass % of 2(2'-hydroxy-4' octoxyphenyl)benzotriazole (by Sumitomo Chemical Co., Ltd.) as an ultraviolet absorbing agent were used. After adjusting the moisture content to 1.0 mass %, the chips were supplied to a melt extruder, melted at a spinning temperature of 255° C., and discharged through the spinning nozzle with 24 spinning orifices 0.3 mm in diameter. The spun filament was blown with cooling air from a cooling apparatus to be solidified, provided with a lubricant using an oiling roller, and taken up at a take-up rate of 4000 m/min to give an antibacterial filament of 44 dtex/24 f.

The evaluations of the strength, elongation, antibacterial properties, color difference before and after treatment with an alkaline solution for the obtained filament are tabulated in Table 1.

TABLE 1

| | | Examples | | | | Comparative Examples | | |
|---|---|---|---|---|---|---|---|---|
| | | 1 | 2 | 3 | 4 | 1 | 2 | 3 |
| Content of uncoated antibacterial agent | | 1.0 | 0.8 | 2.2 | 0.2 | 0 | 6.0 | 1.0 |
| Moisture content of chips (mass %) | | 1.0 | 0.05 | 0.13 | 1.0 | 0.13 | 0.22 | 3.0 |
| Temperature of discharged polymer (° C.) | | 255 | 255 | 255 | 255 | 258 | 258 | 258 |
| Position of solidifying point (mm) | | 375 | 345 | 350 | 370 | 520 | 560 | 560 |
| Blowing temperature (° C.) | | 10 | 10 | 10 | 10 | 15 | 15 | 15 |
| Amount of blowing air (m/min) | | 1.5 | 1.5 | 1.5 | 1.5 | 1.0 | 1.0 | 1.0 |
| Single yarn fineness (dtex) | | 1.86 | 1.86 | 1.86 | 1.86 | 1.86 | 1.86 | 1.86 |
| Yarn physical properties | Strength cN/dtex | 4.24 | 4.01 | 3.92 | 4.21 | 4.28 | X | 4.14 |
| | Elongation (%) | 71.8 | 70.2 | 69.8 | 72.1 | 67.0 | X | 57.3 |
| Anti-bacterial properties | Untreated, Bacteriostatic activity | 5.2* | 5.2* | 5.2* | 4.3 | 0.8 | X | 5.2* |
| | Untreated, Bacteriocidal activity | 2.8 | 2.5 | 2.7 | 2.8 | — | X | 3.0 |
| | After treatment by alkaline solution | 5.2* | 5.2* | 5.2* | 3.9 | 0.3 | X | 4.7 |
| | After 50 time washing, Bacteriostatic activity | 4.3 | 3.9 | 4.4 | 2.9 | 0.1 | X | 1.9 |
| | After 50 time washing, Bacteriocidal activity | 2.7 | 2.5 | 2.5 | 0.8 | — | X | — |
| | After weatherproofing | 3.6 | 3.2 | 3.3 | 2.6 | −0.2 | X | 1.6 |
| Color difference ΔE before and after treatment by alkaline solution | | 1.7 | 1.1 | 1.2 | 1.2 | 1.2 | X | 2.8 |

— . . . less than 0
3.0* . . . 3.0 or more
5.2* . . . 5.2 or more (d) Weatherproofing As described above, weatherproofing test was done with a carbon-arc fadeometer in such a manner as to irradiate (fourth grade irradiation) the filament for 20 hours at 63° C. in accordance with JIS L 0842.

(e) Position of Solidifying Point

The filament diameter was measured with a filament diameter measuring instrument (460A/5, by ZIMMER) at 5 cm intervals downward from the nozzle face for 30 seconds each, the measurements were averaged at each point, and a graph was constructed. The first point (the distance from the bottom of nozzle face) at which the average value was constant (the average value was within a tolerance of ±1%) was defined as solidifying point of filament.

Example 2, Comparative Examples 1 to 2

Changes were made in antibacterial agent content, moisture content of nylon 6 chips, temperature of discharged polymer, position of solidifying point, and blowing temperature and amount of cooling air, as shown in Table 1. The others were the same as Example 1.

Example 3, Comparative Example 3

0.01 mass % of Sandorin Violet BL (by SANDOZ), as a pigment, was added to nylon 6 chips and changes were made in antibacterial agent content, moisture content of nylon 6 chips, temperature of discharged polymer, position of solidifying point, and blowing temperature and amount of cooling air, as shown in Table 1. The others were the same as Example 1.

Example 4

A spinning nozzle with 24 trilobate-shaped spinning orifices was used and a change was made in antibacterial content as shown in Table 1. The others were the same as Example 1, and an antibacterial filament of 44 dtex/24 f having a triangular cross-section with modification degree of 33% was obtained.

The evaluations of strength, elongation, antibacterial properties and color difference before and after treatment with an alkaline solution are shown in Table 1 for the filaments obtained in Examples 2 to 4 and Comparative Examples 1 to 3.

As is evident from table 1, in the antibacterial filaments obtained in Examples 1 to 4, the yarn physical properties such as strength and elongation were excellent, the antibacterial properties were highly evaluated, the color difference before and after treatment with an alkaline solution was small, and the antibacterial properties after 50-time washing as well as after weatherproofing were highly evaluated; accordingly, they can be satisfactorily used in the applications where whiteness, clarity and resistance to washing are required. The filaments of Examples 1 to 3 were produced by the directly spinning and drawing method, and they could be produced at high operating efficiency without causing guide wear, etc.

In Comparative Example 1, the filament obtained did not have antibacterial properties because nylon 6 chips contained no antibacterial agent. In Comparative Example 2, because the antibacterial agent content was too high, end breakage occurred during the spinning and drawing and thereby no filament could be obtained. In Comparative Example 3, because melt spinning was carried out in state where moisture content of chips was high, the color difference before and after treatment with an alkaline solution was large, and the antibacterial performance after 50-time washing deteriorated rapidly.

Examples 5 to 6, Comparative Example 4

A change was made in antibacterial agent content, as shown in Table 2, and a spinning nozzle with 34 spinning orifices was used. The others were the same as Example 1, and an antibacterial polyamide filament of 70 dtex/34 f was obtained. The filament was subjected to false twisting under various false twisting conditions using a false twisting machine provided with a feed roller, a false twist heater, a pin-type false twister, a delivery roller, and a take-up apparatus one by one and crimped yarn was obtained.

The evaluations of strength, elongation, antibacterial properties and color difference before and after treatment with an alkaline solution for the obtained crimped yarn are tabulated in Table 2.

TABLE 2

| | Example | | Comparative Example |
|---|---|---|---|
| | 5 | 6 | 4 |
| Content of uncoated antibacterial agent (mass %) | 0.5 | 1.0 | 0 |

TABLE 2-continued

| | Example | | Comparative Example |
|---|---|---|---|
| | 5 | 6 | 4 |
| False twisting condition | | | |
| Draw ratio | 1.18 | 1.22 | 1.18 |
| Temperature (° C.) | 170 | 165 | 170 |
| Number of false twist (T/m) | 2900 | 3400 | 2900 |
| False twist multiplier | 23000 | 26000 | 23000 |
| Fineness after false twisting (dtex) | 68 | 66 | 68 |
| Yarn physical Properties | | | |
| Strength cN/dtex | 4.03 | 4.22 | 4.01 |
| Elongation (%) | 38.2 | 36.9 | 35.2 |
| Antibacterial Properties | | | |
| Untreated, Bacteriostatic activity | 4.8 | 5.2* | 0.1 |
| Untreated, Bacteriocidal activity | 2.3 | 2.9 | — |
| After treatment by alkaline solution | 4.1 | 5.2 | 0.0 |
| After 50 time washing, Bacteriostatic activity | 3.8 | 4.3 | 0.1 |
| After 50 time washing, Bacteriocidal activity | 1.7 | 2.5 | — |
| After weatherproofing | 2.9 | 3.1 | −0.3 |
| Color difference ΔE before and after treatment by alkaline solution | 1.3 | 1.1 | 1.5 |

— . . . less than 0
3.0* . . . 3.0 or more
5.2* . . . 5.2 or more

As is evident from Table 2, in the antibacterial crimped yarn obtained in Examples 5 to 6, the yarn physical properties such as strength and elongation were excellent, the antibacterial properties were highly evaluated, the color difference before and after treatment with an alkaline solution was small, and the antibacterial properties after 50-time washing as well as after weatherproofing were highly evaluated; accordingly, they can be satisfactorily used in the applications where whiteness, clarity and resistance to washing are required.

In Comparative Example 4, the filament obtained did not have antibacterial properties because nylon 6 chips contained no antibacterial agent.

Example 7

A plain weave fabric with a warp density of 140 warps/2.54 cm and a weft density of 108 wefts/2.54 cm was woven using the filament of Example 1 as warp and weft. The antibacterial properties and the color difference caused by treatment with an alkaline solution of the plain weave fabric were determined and evaluated.

Not only in Example 7 but also in Examples 8 to 10, these evaluations and determinations, which had been made for the knitted fabric, were made for the woven fabric.

Example 8

A plain weave fabric with a warp density of 114 warps/2.54 cm and a weft density of 86 wefts/2.54 cm was woven using the crimped yarn of Example 5 as warp and weft. The others were the same as Example 7.

Example 9

A plain weave fabric (the mixing rate of the antibacterial filament was 56%) with a warp density of 140 warps/2.54 cm and a weft density of 108 wefts/2.54 cm was woven using the filament of Example 1 as warp and the filament of Comparative Example 1 as weft. The others were the same as Example 7.

Example 10

A plain weave fabric (the mixing rate of the antibacterial crimped yarn was 26%) with a warp density of 114 warps/2.54 cm and a weft density of 62 wefts/2.54 cm was woven using the confounded mixed filament yarn, obtained by subjecting the crimped yarn of Example 5 and the crimped yarn of Comparative Example 4 to air confounding treatment with Interlacer JD-1 by Dupont, as warp and the crimped yarn of Comparative Example 4 as weft. The others were the same as Example 7.

Example 11

A tricot knitted fabric was obtained based on mesh construction using the filament of Example 1.

Example 12

An interlaced knitted fabric (tubular knitting, the mixing rate of the antibacterial filament was 65%) was obtained based on Moclaudia construction using the filaments of Example 1 and Comparative Example 1.

The evaluations of the antibacterial properties and the color difference after treatment with an alkaline solution for the woven fabrics of Examples 7 to 10 and the knitted fabrics of Examples 11 to 12 are tabulated in Table 3.

TABLE 3

| | | Example | | | | | |
|---|---|---|---|---|---|---|---|
| | | 7 | 8 | 9 | 10 | 11 | 12 |
| Anti-bacterial properties | Untreated, Bacteriostatic activity | 5.2* | 5.2 | 4.8 | 4.2 | 5.2* | 5.1 |
| | Untreated, Bacteriocidal activity | 2.7 | 2.7 | 2.5 | 0.9 | 2.7 | 2.2 |
| | After treatment by alkaline solution, After dyeing | 5.2* | 4.2 | 4.1 | 2.7 | 5.0 | 4.6 |
| | After 50-time washing, Bacteriostatic activity | 4.2 | 4.1 | 3.7 | 2.5 | 4.1 | 3.2 |
| | After 50-time washing, Bacteriocidal activity | 2.1 | 2.0 | 2.0 | 1.8 | 2.4 | 2.3 |
| | After weatherproofing | 3.5 | 3.2 | 2.9 | 2.3 | 3.5 | 2.7 |
| Color difference ΔE before and after treatment by alkaline solution | | 1.5 | 1.2 | 1.6 | 1.4 | 1.3 | 1.4 |

5.2* . . . 5.2 or more

As is evident from Table 3, in the woven and knitted fabric produced using the antibacterial filament or the antibacterial crimped yarn of the invention at least in parts, the antibacterial properties were highly evaluated, the color difference caused by treatment with an alkaline solution was small, and the antibacterial properties after 50-time washing as well as after weatherproofing were highly evaluated; accordingly, they can be satisfactorily used in the applications where whiteness, clarity and resistance to washing are required.

Example 13

Chips of nylon 6 with a relative viscosity of 2.53, measured in the same manner as Example 1, which contain 1.1 mass % of fine zinc oxide particles coated with a silane coupling agent (Z-NOUVE, by Mitsui Mining and Smelting Co., Ltd., average particle diameter 0.2 μm) as an antibacterial agent were used. After adjusting the moisture content to 0.07 mass %, the chips were supplied to a melt extruder, melted at a spinning temperature of 248° C., and discharged through the spinning nozzle with 24 spinning orifices of 0.3 mm in diameter. The filament was blown with cooling air from a cooling apparatus under the conditions shown in Table 4 to be and solidified, provided with a lubricant using an oiling roller, and taken up at a take-up rate of 4000 m/min to give an antibacterial filament of 44 dtex/24 f.

Examples 14 to 15, Comparative Examples 5 to 6

Changes were made in antibacterial agent content, moisture content of nylon 6 chips, blowing temperature and amount of cooling air, and position of solidifying point, as shown in Table 4. The others were the same as Example 13.

Example 16

0.01 mass % of Sandorin Violet BL (by SAN-DOZ), as a pigment, was added to nylon 6 chips and changes were made in antibacterial agent content, moisture content of nylon 6 chips, and position of solidifying point, as shown in Table 4. The others were the same as Example 13.

Examples 17 to 19, Comparative Example 7

Changes were made in antibacterial agent content, moisture content of nylon 6 chips, blowing temperature and amount of cooling air, position of solidifying point, and temperature of discharged polymer, as shown in Table 4. The others were the same as Example 13. The filaments of 78 dtex/24 f were obtained in respective examples and Comparative Example.

Example 20, Comparative Example 8

0.1 mass % of Yellow 10 G (by BAYER), as a pigment, was added to nylon 6 chips and changes were made in antibacterial agent content, moisture content of nylon 6 chips, blowing temperature and amount of cooling air, position of solidifying point, and temperature of discharged polymer, as shown in Table 4. The others were the same as Example 13. The filaments of 78 dtex/24 f were obtained in respective example and Comparative Example.

The evaluations of the strength, elongation, antibacterial properties, and color difference before and after treatment with an alkaline solution for the filaments obtained in Examples 13 to 20 and Comparative Examples 5 to 8 are tabulated in Table 4.

TABLE 4

| | | Example | | | | | | | | Comparative Example | | | |
|---|---|---|---|---|---|---|---|---|---|---|---|---|---|
| | | 13 | 14 | 15 | 16 | 17 | 18 | 19 | 20 | 5 | 6 | 7 | 8 |
| Content of antibacterial agent (mass %) | | 1.1 | 0.2 | 2.5 | 0.7 | 0.3 | 2.1 | 1.5 | 0.6 | 1.1 | 0.5 | 2.3 | 1.0 |
| Moisture content of chips (mass %) | | 0.07 | 1.3 | 0.15 | 1.0 | 1.0 | 0.7 | 0.1 | 1.6 | 1.0 | 1.0 | 1.0 | 1.0 |
| Temperature of discharged polymer (° C.) | | 248 | 248 | 248 | 248 | 246 | 246 | 246 | 246 | 258 | 258 | 258 | 258 |
| Position of solidifying point (mm) | | 320 | 340 | 345 | 330 | 385 | 390 | 390 | 390 | 580 | 560 | 920 | 850 |
| Blowing temperature (° C.) | | 10 | 10 | 10 | 10 | 5 | 5 | 5 | 5 | 15 | 15 | 15 | 15 |
| Amount of blowing air (m/min) | | 1.5 | 1.5 | 1.5 | 1.5 | 1.8 | 1.8 | 1.8 | 1.8 | 1.0 | 1.0 | 1.0 | 1.0 |
| Single yarn fineness (dtex) | | 1.86 | 1.86 | 1.86 | 1.86 | 3.22 | 3.22 | 3.22 | 3.22 | 1.86 | 1.86 | 3.22 | 3.22 |
| Yarn physical properties | Strength cN/dtex | 4.08 | 4.14 | 4.04 | 4.13 | 4.11 | 4.05 | 4.10 | 4.15 | 4.10 | 4.15 | 4.00 | 4.15 |
| | Elongation (%) | 71.3 | 72.3 | 69.9 | 70.9 | 71.9 | 70.1 | 71.5 | 72.1 | 70.8 | 71.6 | 69.5 | 71.3 |
| Anti bacterial properties | Untreated, Bacteriostatic activity | 5.2* | 4.5 | 5.2* | 5.2* | 4.8 | 5.2* | 5.2* | 5.2* | 5.2* | 4.5 | 5.2* | 4.8 |
| | Untreated, Bacteriocidal activity | 3.0* | 2.6 | 3.0* | 2.9 | 2.5 | 2.7 | 3.0* | 2.7 | 3.0* | 2.6 | 3.0* | 2.2 |
| | After treatment by an alkaline solution | 5.2* | 4.1 | 5.2* | 5.2* | 4.4 | 5.2* | 5.2* | 5.2* | 3.7 | 3.1 | 3.4 | 3.1 |
| | After 50-time washing, Bacteriostatic activity | 4.9 | 3.9 | 5.0 | 4.8 | 4.1 | 5.0 | 4.8 | 4.8 | 1.9 | 1.5 | 1.2 | 1.5 |
| | After 50-time washing, Bacteriocidal activity | 2.9 | 1.8 | 3.0 | 2.7 | 2.4 | 2.8 | 2.9 | 2.6 | — | — | — | — |
| | After weatherproofing | 4.8 | 4.1 | 4.8 | 4.7 | 4.2 | 4.9 | 5.0 | 5.0 | 1.7 | 1.3 | 1.3 | 1.0 |
| Color difference ΔE before and after treatment by alkaline solution | | 0.7 | 0.5 | 0.8 | 0.5 | 0.5 | 1.2 | 0.7 | 0.4 | 1.1 | 0.8 | 1.3 | 0.9 |

— . . . less than 0
3.0* . . . 3.0 or more
5.2* . . . 5.2 or more

Example 21

Chips of nylon 6 with the same relative viscosity as those used in Example 13 which contain 1.0 mass % of fine zinc oxide particles coated in the same manner were used. After adjusting the moisture content to 1.0 mass %, the chips were supplied to a melt extruder, melted at a spinning temperature of 255° C., and discharged through the spinning nozzle with 34 spinning orifices of 0.3 mm in diameter. Roller type liquid medium supplying means was provided in the position 390 mm away downwardly from the nozzle face (taken as solidifying point), and water was used as a liquid medium and supplied to the spun filament to solidify the same. At this time, the temperature of water was 25° C. and the amount of water provided was 5 milliliter/min. Then the solidified filament was provided with a lubricant using an oiling roller, and taken up at a take-up rate of 3000 m/min to give an antibacterial filament of 235 dtex/34 f.

Example 22, Comparative Example 9

Changes were made in antibacterial agent content, moisture content of nylon 6 chips, and position of solidifying point, as shown in Table 5. The others were the same as Example 21.

Examples 23 to 24, Comparative Example 10

Slit nozzle type liquid medium supplying means, shown in FIG. 2, was used instead of roller type liquid medium supplying means as solidifying means, and water at 10° C. was provided at 10 milliliter/min to solidify the spun filament. In addition, changes were made in antibacterial agent content, moisture content of nylon 6 chips, and position of solidifying point, as shown in Table 5. The others were the same as Example 21.

The evaluations of the strength, elongation, antibacterial properties, and color difference before and after treatment with an alkaline solution for the filaments obtained in Examples 21 to 24 and Comparative Examples 9 to 10 are tabulated in Table 5.

TABLE 5

| | Example | | | | Comparative Example | |
|---|---|---|---|---|---|---|
| | 21 | 22 | 23 | 24 | 9 | 10 |
| Content of antibacterial agent (mass %) | 1.0 | 1.5 | 0.7 | 1.3 | 0.3 | 2.1 |
| Moisture content of chips (mass %) | 1.0 | 0.3 | 0.9 | 1.3 | 0.7 | 1.1 |
| Temperature of discharged polymer (° C.) | 255 | 255 | 248 | 248 | 255 | 248 |
| Cooling means | Roller | Roller | Slit nozzle | Slit nozzle | Roller | Slit nozzle |
| Amount of liquid provided (ml/min) | 5 | 5 | 10 | 10 | 5 | 10 |

TABLE 5-continued

| | | Example | | | | Comparative Example | |
|---|---|---|---|---|---|---|---|
| | | 21 | 22 | 23 | 24 | 9 | 10 |
| Temperature of liquid (° C.) | | 25 | 25 | 10 | 10 | 25 | 10 |
| Position of solidifying point (position at which liquid is provided) (mm) | | 390 | 395 | 380 | 385 | 950 | 750 |
| Single yarn fineness (dtex) | | 6.89 | 6.89 | 6.89 | 6.89 | 6.89 | 6.89 |
| Yarn physical properties | Strength cN/dtex | 4.07 | 4.10 | 4.19 | 4.08 | 4.16 | 4.04 |
| | Elongation (%) | 73.5 | 72.9 | 73.1 | 70.9 | 71.6 | 70.2 |
| Antibacterial properties | Untreated, Bacteriostatic activity | 5.2* | 5.2* | 5.2* | 5.2* | 4.6 | 5.2* |
| | Untreated, Bacteriocidal activity | 3.0* | 3.0* | 3.0* | 3.0* | 2.4 | 3.0* |
| | After treatment by an alkaline solution | 5.2* | 5.2* | 5.2* | 5.2* | 4.1 | 5.2* |
| | After 50-time washing, Bacteriostatic activity | 5.2* | 5.2* | 4.8 | 4.9 | 1.3 | 1.9 |
| | After 50-time washing, Bacteriocidal activity | 3.0* | 3.0* | 3.0* | 3.0* | — | — |
| | After weatherproofing | 5.1 | 5.2* | 5.1 | 5.1 | 2.1 | 2.0 |
| Color difference ΔE before and after treatment by alkaline solution | | 0.9 | 1.2 | 0.7 | 1.1 | 0.8 | 1.4 |

— . . . less than 0
3.0* . . . 3.0 or more
5.2* . . . 5.2 or more

Example 25

Chips of nylon 6 with a relative viscosity of 2.53, measured in the same manner as in Example 1, which contain 1.0 mass % of fine zinc oxide particles coated in the same manner as those of Example 21 were used. After adjusting the moisture content to 0.05 mass %, the chips were supplied to a melt extruder, melted at a spinning temperature of 255° C., and discharged through the spinning orifice of 2.0 mm in diameter. The extruded monofilament was quenched in a water bath located 20 mm away downwardly from the nozzle face taken as solidifying point, drawn by the total of 5.3 times by conventional procedure, and thermoset to give an antibacterial monofilament of 1120 dtex.

Examples 26 to 27, Comparative Examples 11 to 12

Changes were made in antibacterial agent content, moisture content of nylon 6 chips, and position of solidifying point, as shown in Table 6. The others were the same as Example 25.

The evaluations of the strength, elongation, antibacterial properties, and color difference before and after treatment with an alkaline solution for the monofilaments obtained in Examples 25 to 27 and Comparative Examples 11 to 12 are tabulated in Table 6.

TABLE 6

| | | Example | | | Comparative Example | |
|---|---|---|---|---|---|---|
| | | 25 | 26 | 27 | 11 | 12 |
| Content of antibacterial agent (mass %) | | 1.0 | 2.1 | 0.3 | 0.5 | 2.3 |
| Moisture content of chips (mass %) | | 0.05 | 1.0 | 0.7 | 0.8 | 1.2 |
| Temperature of discharged polymer (° C.) | | 255 | 255 | 255 | 255 | 255 |
| Temperature of cooling bath (° C.) | | 10 | 10 | 10 | 10 | 10 |
| Position of solidifying point (position of bath from nozzle face) (mm) | | 20 | 50 | 110 | 480 | 530 |
| Single yarn fineness (dtex) | | 1120 | 1120 | 1120 | 1120 | 1120 |
| Yarn physical properties | Strength (cN/dtex) | 6.86 | 6.83 | 7.18 | 7.01 | 6.99 |
| | Elongation (%) | 19.8 | 20.3 | 22.5 | 23.5 | 20.1 |
| Antibacterial properties | Untreated, Bacteriostatic activity | 5.2* | 5.2* | 4.8 | 5.0 | 5.2* |
| | Untreated, Bacteriocidal activity | 3.0* | 3.0* | 2.6 | 2.4 | 3.0* |
| | After treatment by an alkaline solution | 5.2* | 5.2* | 4.6 | 3.2 | 3.6 |
| | After 50-time washing, Bacteriostatic activity | 4.8 | 4.9 | 4.3 | 1.2 | 2.0 |
| | After 50-time washing, Bacteriocidal activity | 2.6 | 2.8 | 2.1 | — | — |
| | After weatherproofing | 4.8 | 4.8 | 4.4 | 1.8 | 1.9 |
| Color difference ΔE before and after treatment by an alkaline solution | | 0.7 | 0.9 | 0.5 | 1.2 | 1.4 |

— . . . less than 0
3.0* . . . 3.0 or more
5.2* . . . 5.2 or more

As is evident from Tables 4 to 6, in the antibacterial filaments obtained in Examples 13 to 24 and the antibacterial monofilaments obtained in Examples 25 to 27, the yarn physical properties such as strength and elongation were excellent, the color difference before and after treatment with an alkaline solution was small, and the antibacterial properties after 50-time washing as well as after weatherproofing were highly evaluated; accordingly, they can be satisfactorily used in the applications where whiteness, clarity and resistance to washing are required. The filaments and monofilaments of Examples 13 to 27 were produced by the directly spinning and drawing method, and they could be produced at high operating efficiency without causing guide wear, etc.

In the filaments obtained in Comparative Examples 5 to 8, although the antibacterial properties before treatment with an alkaline solution was high, the antibacterial performance after 50-time washing deteriorated rapidly and the antibacterial properties after weatherproofing also deteriorated considerably, because the cooling conditions and the like were not optimum and the solidifying point could not be positioned within 400 mm away from the nozzle face. In the filament and monofilaments obtained in Comparative Examples 9 to 12, although the antibacterial properties before treatment with an alkaline solution was high, the antibacterial performance after 50-time washing deteriorated rapidly and the antibacterial properties after weatherproofing also deteriorated considerably, because the solidifying point (position of the roller type or slit type liquid medium supplying means and the position of the cooling bath) was not within 400 mm away from the nozzle face.

Examples 28 to 29, Comparative Example 13

A change was made in content of antibacterial agent as shown in Table 7 and a spinning nozzle with 34 spinning orifices was used. The others were the same as Example 13 and a filament of 78 dtex/34 f was obtained. The obtained antibacterial polyamide filament was subjected to false twisting under various false twisting conditions as shown in Table 7 using a false twisting machine provided with a feed roller, a false twist heater, a pin-type false twister, a delivery roller, and a take-up apparatus one by one and crimped yarn was obtained.

The evaluations of strength, elongation, antibacterial properties and color difference before and after treatment with an alkaline solution for the obtained crimped yarn are tabulated in Table 7.

TABLE 7

| | Example | | Comparative Example |
|---|---|---|---|
| | 28 | 29 | 13 |
| Content of antibacterial agent (mass %) | 0.7 | 1.3 | 0 |
| False twisting conditions | | | |
| Draw ratio | 1.18 | 1.22 | 1.18 |
| Temperature (° C.) | 170 | 165 | 170 |
| Number of false twist (T/m) | 2900 | 3400 | 2900 |
| False twist multiplier | 23000 | 26000 | 23000 |
| Fineness after false twisting (dtex) | 68.9 | 66.7 | 68.9 |
| Yarn physical properties | | | |
| Strength (cN/dtex) | 4.07 | 4.22 | 4.04 |
| Elongation (%) | 37.9 | 37.1 | 35.2 |

TABLE 7-continued

| | Example | | Comparative Example |
|---|---|---|---|
| | 28 | 29 | 13 |
| Antibacterial properties | | | |
| Untreated, Bacteriostatic activity | 5.2* | 5.2* | 0.1 |
| Untreated, Bacteriocidal activity | 3.0* | 3.0* | — |
| After treatment by alkaline solution | 5.2* | 5.2* | 0 |
| After 50-time washing, Bacteriostatic activity | 4.9 | 4.8 | 0 |
| After 50-time washing, Bacteriocidal activity | 2.7 | 2.8 | — |
| After weatherproofing | 4.8 | 4.9 | −0.3 |
| Color difference ΔE before and after treatment by alkaline solution | 0.7 | 0.9 | 1.2 |

— . . . less than 0
3.0* . . . 3.0 or more
5.2* . . . 5.2 or more

As is evident from Table 7, in the antibacterial filaments obtained in Examples 28 to 29, the yarn physical properties such as strength and elongation were excellent, the color difference before and after treatment with an alkaline solution was small, and the antibacterial properties after 50-time washing as well as after weatherproofing were highly evaluated; accordingly, they can be satisfactorily used in the applications where whiteness, clarity and resistance to washing are required.

In Comparative Example 13, the filament obtained did not have antibacterial properties because nylon 6 chips contained no antibacterial agent.

Example 30

A plain weave fabric with a warp density of 140 warps/2.54 cm and a weft density of 108 wefts/2.54 cm was woven using the filament of Example 13 as warp and weft. The antibacterial properties and the color difference before and after treatment with an alkaline solution of the plain weave fabric were determined and evaluated.

These evaluations and determinations, which had been made for the knitted fabric, were made for the woven fabric.

Example 31

A plain weave fabric with a warp density of 114 warps/2.54 cm and a weft density of 86 wefts/2.54 cm was woven using the crimped yarn of Example 28 as warp and weft. The antibacterial properties and the color difference before and after treatment with an alkaline solution of the plain weave fabric were determined and evaluated in the same manner as in Example 30.

Example 32

A plain weave fabric (the mixing rate of the antibacterial filament was 56%) with a warp density of 140 warps/2.54 cm and a weft density of 108 wefts/2.54 cm was woven using the filament of Example 13 as warp and the filament of Comparative Example 13 as weft. The antibacterial properties and the color difference before and after treatment with an alkaline solution of the plain weave fabric were determined and evaluated in the same manner as in Example 30.

Example 33

Confounded mixed filament yarn was obtained by subjecting the crimped yarn of Example 28 and the crimped yarn of Comparative Example 13 to air confounding treatment with Interlacer JD-1 by Du Pont. A plain weave fabric (the mixing rate of the antibacterial crimped yarn was 26%) with a warp density of 114 warps/2.54 cm and a weft density of 62 wefts/2.54 cm was woven using the confounded mixed filament yarn as warp and the crimped yarn of Comparative Example 14 as weft. The antibacterial properties and the color difference before and after treatment with an alkaline solution of the plain weave fabric were determined and evaluated in the same manner as in Example 30.

Example 34

A tricot knitted fabric was obtained based on mesh construction using the filament of Example 13. The antibacterial properties and the color difference before and after treatment with an alkaline solution of the tricot knitted fabric were determined and evaluated in the same manner as in Example 30.

Example 35

An interlaced knitted fabric (tubular knitting, the mixing rate of the antibacterial filament was 65%) was obtained based on Moclaudia construction using the filaments of Example 13 and Comparative Example 13. The antibacterial properties and the color difference before and after treatment with an alkaline solution of the interlaced knitted fabric were determined and evaluated in the same manner as in Example 30.

The evaluations of the antibacterial properties and the color difference before and after treatment with an alkaline solution for the woven fabrics of Examples 20 to 33 and the knitted fabrics of Examples 34 to 35 are tabulated in Table 8.

TABLE 8

| | | Example | | | | | |
|---|---|---|---|---|---|---|---|
| | | 30 | 31 | 32 | 33 | 34 | 35 |
| Anti-bacterial properties | Untreated, Bacteriostatic activity | 5.2* | 5.2* | 5.2* | 5.2* | 5.2* | 5.2* |
| | Untreated, Bacteriocidal activity | 3.0* | 3.0* | 3.0* | 3.0* | 3.0* | 3.0* |

TABLE 8-continued

| | | Example | | | | | |
|---|---|---|---|---|---|---|---|
| | | 30 | 31 | 32 | 33 | 34 | 35 |
| | After treatment by alkaline solution | 5.2* | 5.2* | 5.2* | 5.2* | 5.2* | 5.1 |
| | After 50-time washing, Bacteriostatic activity | 4.9 | 4.6 | 4.3 | 4.3 | 4.8 | 4.5 |
| | After 50-time washing, Bacteriocidal activity | 2.7 | 2.3 | 2.3 | 2.4 | 2.9 | 2.3 |
| | After weatherproofing | 4.7 | 4.9 | 4.7 | 4.4 | 4.9 | 4.8 |
| Color difference ΔE before and after treatment by alkaline solution | | 0.9 | 1.1 | 0.8 | 0.7 | 1.1 | 0.7 |

3.0* . . . 3.0 or more
5.2* . . . 5.2 or more

As is evident from Table 8, in the woven and knitted fabric produced using the antibacterial filament or the antibacterial crimped yarn of the invention at least in parts, the antibacterial properties were highly evaluated and the color difference before and after treatment with an alkaline solution was small; accordingly, they can be satisfactorily used in the applications where whiteness and clarity are required.

The invention claimed is:

1. An antibacterial polyamide filament, comprising polyamide resin containing 0.1 to 5.0 mass % of fine zinc oxide particles and exhibiting a color difference ΔE of the filament between before and after treatment with an alkaline solution of 2.5 or less.

2. The antibacterial polyamide filament according to claim 1, wherein surfaces of the fine zinc oxide particles are coated with a coupling agent and the color difference ΔE of the filament between before and after treatment with an alkaline solution is 2.0 or less.

3. The antibacterial polyamide filament according to claim 1, wherein a cross sectional shape of the filament is modified with a modification degree of 20 to 60%.

4. An antibacterial polyamide crimped yarn, produced by crimping the antibacterial polyamide filament according to any one of claims 1 to 3.

5. An antibacterial polyamide woven and knitted fabric, produced using, at least in parts, the antibacterial polyamide filament according to any one of claims 1 to 3.

6. An antibacterial polyamide woven and knitted fabric, produced using, at least in parts, the antibacterial polyamide crimped yarn according to claim 4.

* * * * *